US006386777B1

(12) United States Patent
Lee

(10) Patent No.: US 6,386,777 B1
(45) Date of Patent: May 14, 2002

(54) PENCIL ASSEMBLY

(76) Inventor: Chin-Kun Lee, 1st Fl., No. 10, lane 45, Jiu-Lu-Tu Street, San-Chung City, Taipei County (TW)

( * ) Notice: Subject to any disclaimer, the term of this patent is extended or adjusted under 35 U.S.C. 154(b) by 0 days.

(21) Appl. No.: 09/535,011

(22) Filed: Mar. 24, 2000

(51) Int. Cl.[7] ..... B43K 27/04
(52) U.S. Cl. ..... 401/34
(58) Field of Search ..... 401/18, 34, 48

(56) References Cited

U.S. PATENT DOCUMENTS 5,791,798 A * 8/1998 Yu ..... 401/57

* cited by examiner

*Primary Examiner*—David J. Walczak
*Assistant Examiner*—Peter deVore
(74) *Attorney, Agent, or Firm*—Bacon & Thomas, PLLC

(57) ABSTRACT

A pencil assembly. The assembly can be elongated so that substantially all of the pencil can be more completely used. The pencil assembly includes a main shank provided with a fixing annular member on one end of the main shank, and a connecting shank provided with a fixing collar on another end of the main shank. By mutually connecting the fixing annular member and the fixing collar of the main shank and connecting shank, the main shank and the connecting shank are connected with each other.

3 Claims, 5 Drawing Sheets

PENCIL ASSEMBLY

BACKGROUND OF THE INVENTION

1. Field of the invention

The present invention is related to a structure of pencil assembly which can be elongated by combination. And especially is related to a structure of pencil assembly provided with a main shank of the pencil having a fixing annular member thereon, and with a connecting shank for elongating the pencil and having a fixing collar thereon, thereby a user can hold it conveniently, and an object of environmental protection can be obtained.

2. Description of the Prior Art

When people use pencils pared with a knife, the pencil will get shorter and shorter in repeated using and paring. And when the remaining pencil is about ⅓ the length, it is discarded for being hard to hold. In the present days, resource is very limited, wood exploitation is subjected to destroying of woods and human living environment, waste of such resource thereby is necessarily prohibited and improved.

The pencil auxiliary rods sold in the markets (referring to FIG. 1 and 2) nowadays are comprised of a holding rod 10 and a sleeve 20. The holding rod 10 is provided with a flange 11 on the lower portion thereof, the latter is provided with a thread and a plurality of clamping pieces 12. The sleeve 20 is provided with a through hole 21 extending therethrough, the through hole 21 allows extending therein the holding rod 10 to fixedly connect therewith by screwing in. When the length of a pencil 30 is inadequate for holding by a user, it can be inserted among the clamping pieces 12 of the holding rod 10, and then the sleeve 20 is screwed tight to render the clamping pieces 12 to hold the pencil 30. Thereby, the pencil 30 is fixedly connected with the holding rod 10 to solve the problem of inability of holding to allow continuous using of the main shank of the pencil.

The conventional auxiliary rods can make continuous using of pencils, however, they have the following defects:

1. Cost of production of the auxiliary rods is high; the clamping pieces on the holding rods are subjected to breakage and deformation to render them unable for use.

2. The pencils are inserted in the holding rods and locked by screwing in the sleeve, it is often that a user writes with overly large force to make contracting of a pencil into a holding rod to result the case of inability or uneasiness of taking out the pencil.

3. When a pencil is connected with a holding rod, the tailing end thereof shall give quite a length for holding, otherwise, the case of unstable holding and shaking may result. Therefore, although the pencil can be used till a shorter length, but it is still unable to use all the length thereof.

SUMMARY OF THE INVENTION

Based on the above defects resided in the conventional auxiliary rods for elongating pencils, the inventor of the present invention considered to elongate a pencil by a simplest and surest way to save the cost of producing the auxiliary rods and to increase convenience of assembling and use of the pencil. Therefore, the inventor of the present invention provides the structure of pencil assembly of the present invention based on his professional experience of years in studying, designing and manufacturing the similar products, and putting in very much spirit and energy, as well as after multiple examinations and tests. Thereby, waste of resource and the defects resided in the conventional auxiliary rods can be gotten rid of.

The primary object of the present invention is to provide a structure of pencil assembly which is simple and convenient in assembling. Wherein, a main shank of the pencil is provided with a fixing annular member, and a connecting shank of the pencil is provided thereon a fixing collar. By connecting of the fixing annular member and the connecting shank of the pencil, the pencil assembly can be elongated. This not only can get rid of the defect of the conventional auxiliary rods, but can also obtain the objects of environmental protection and reducing of production cost.

The present invention will be apparent after reading the detailed description of the preferred embodiment thereof in reference to the accompanying drawings.

DETAILED DESCRIPTION OF THE PREFERRED EMBODIMENT

Figure 1:
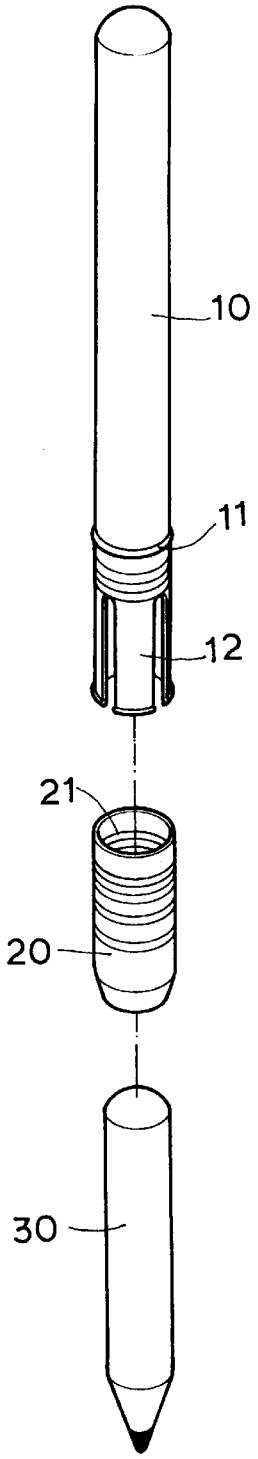
FIG.1 PRIOR ART
FIG. 1 is an analytic schematic perspective view showing a conventional auxiliary rod used for a pencil.
Figure 2:
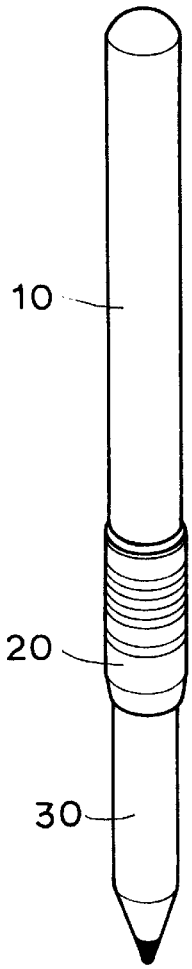
FIG.2 PRIOR ART
FIG. 2 is a perspective view showing the conventional auxiliary rod used for a pencil after assembling.
Figure 5:
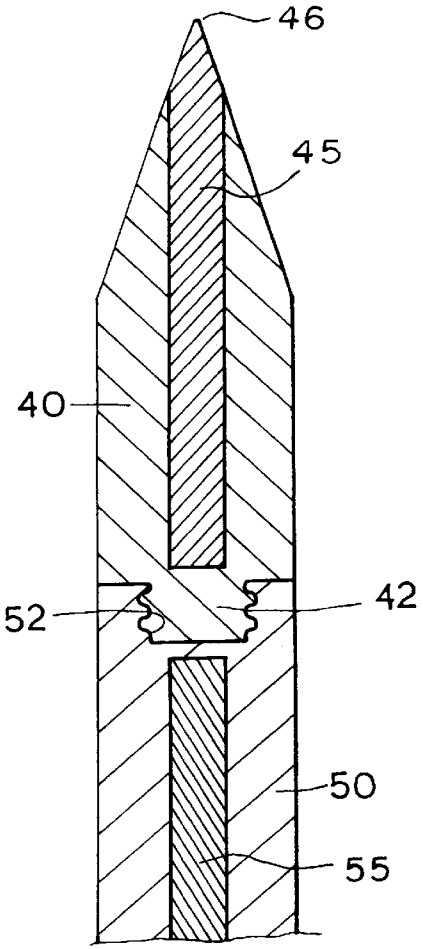
FIG. 5 is a sectional view showing another embodiment of the present invention after assembling.
Figure 4:
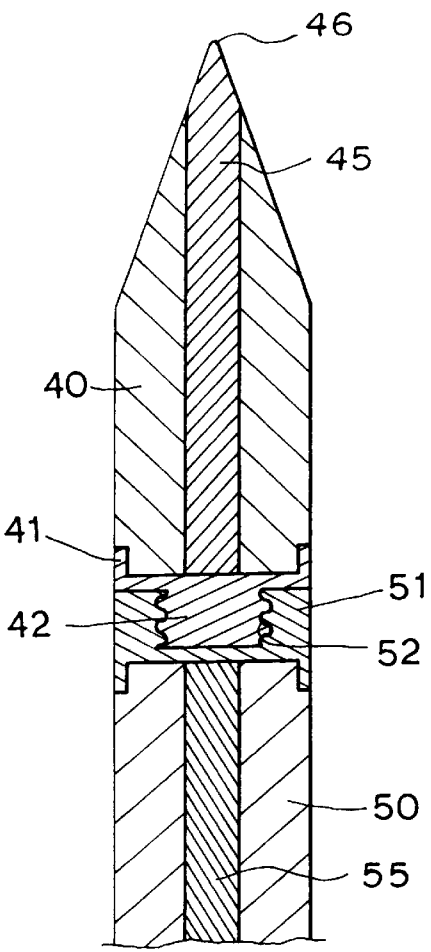
FIG. 4 is a sectional view showing the present invention after assembling.
Figure 3:
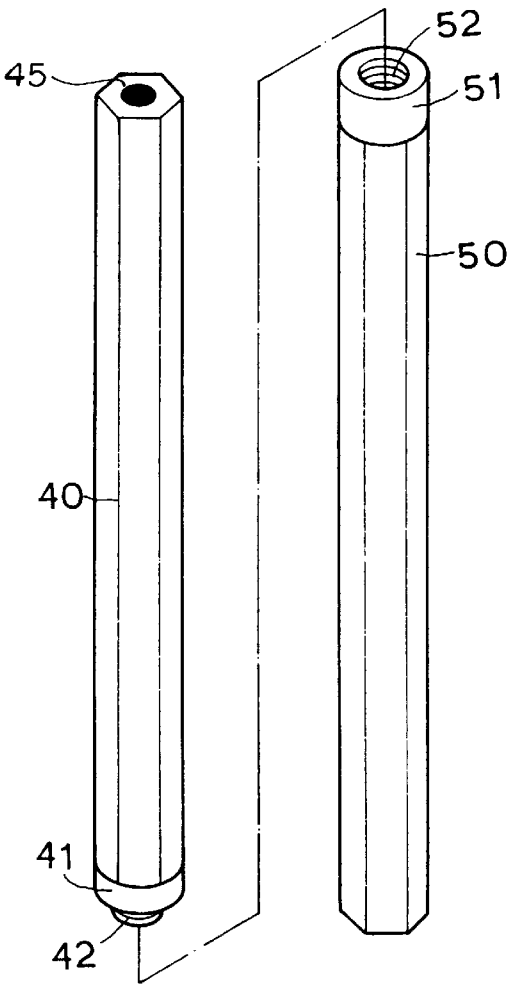
FIG. 3 is an analytic schematic perspective view of the present invention.

Referring to FIG. 3 to 5, the present invention is comprised mainly of a main shank 40 and a connecting shank 50 of the pencil. The main shank 40 is provided with a fixing annular member 41 which is further provided with a locking stub 42 with an external thread thereon. A fixing collar 51 is provided on the connecting shank 50 in cooperation with the fixing annular member 41. The fixing collar 51 is provided at the center thereof with a locking hole 52 for screw locking the locking stub 42. The locking hole 52 is provided therein with an inner thread. The locking stub 42 and the locking hole 52 can be provided in an alternative way, i.e., the locking stub 42 is provided on the fixing collar 51, while the locking hole 52 is provided on the fixing annular member 41.

The main shank 40 includes the writing shaft 45 housed longitudinally and substantially along the length and inside of the main shank, with the sharpened end forming the writing tip 46, as shown in FIGS. 4 and 5. The connecting shank 50 also includes a writing shaft 55 housed longitudinally and substantially along the length and inside of the connecting shank 50.

When the main shank 40 is used and pared repeatedly, and the length thereof is reduced to a degree which is inconvenient for holding, the locking stub 42 provided on the tailing end of the main shank 40 can be screw fixed in the locking hole 52 of the connecting shank 50, so that by adding the length on the connecting shank 50, the pencil can be held conveniently, and the main shank 40 can be used continuously to make it be totally used.

The connecting shank 50 can be used in cooperation with a main shank 40; and it can be pared for use when the main shank 40 is completely used. Fixing of a main shank 40 with the connecting shank 50 of the present invention is fast and convenient, and can largely reduce waste of resource. The fixing annular member 41 and the fixing collar 51 can be integrally formed with the main shank 40 and the connecting shank 50 respectively, i.e., the main shank 40 is provided on one end thereof directly with the protruding locking stub 42, and the connecting shank 50 is provided on one end of directly with the locking hole 52 connectable with the locking stub 42 (as shown in FIG. 5).

Figure 6:
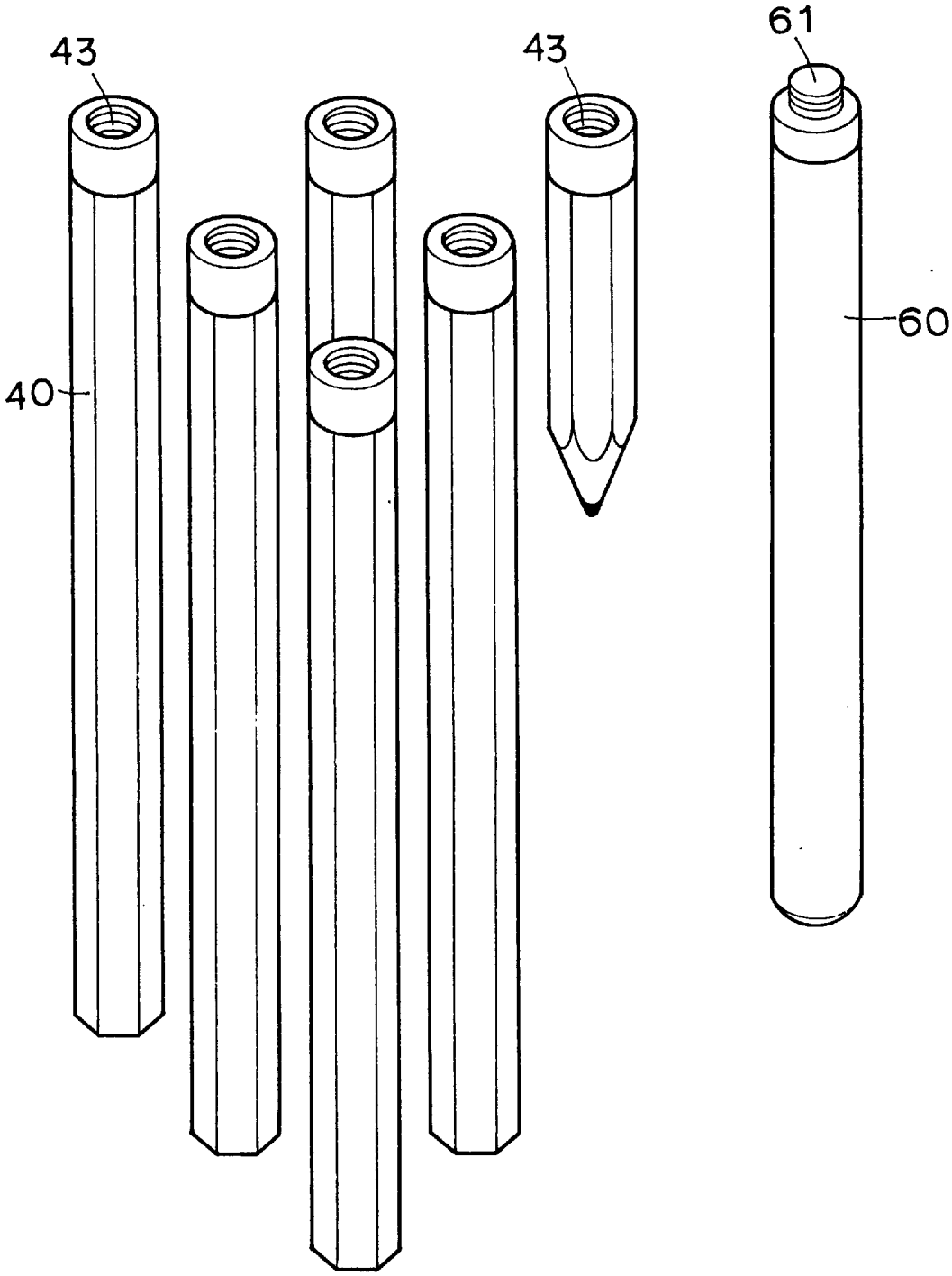
FIG. 6 is a schematic perspective view showing another embodiment of the present invention.
Figure 7:
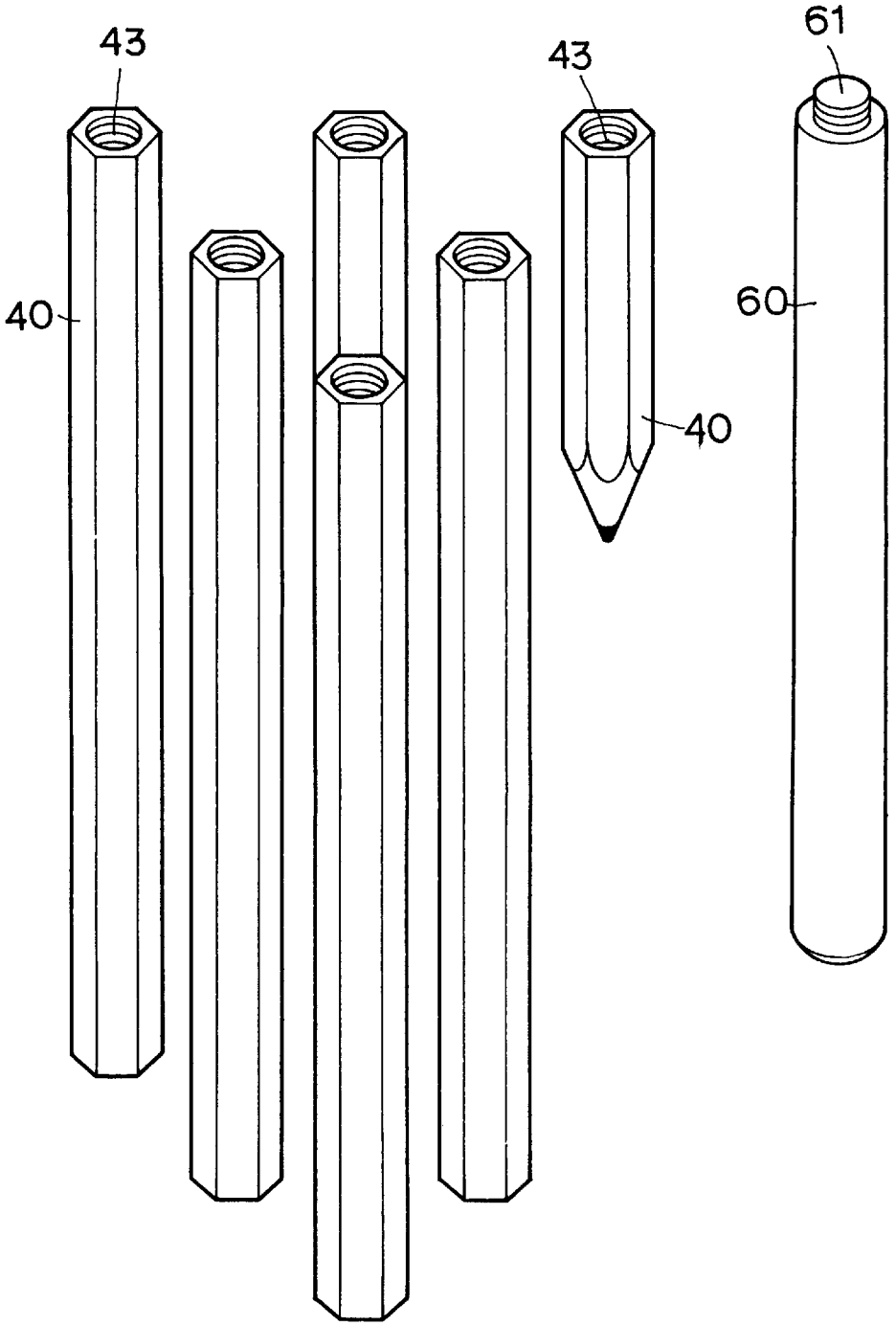
FIG. 7 shows another embodiment of the present invention as compared with FIG. 6.
Figure 8:
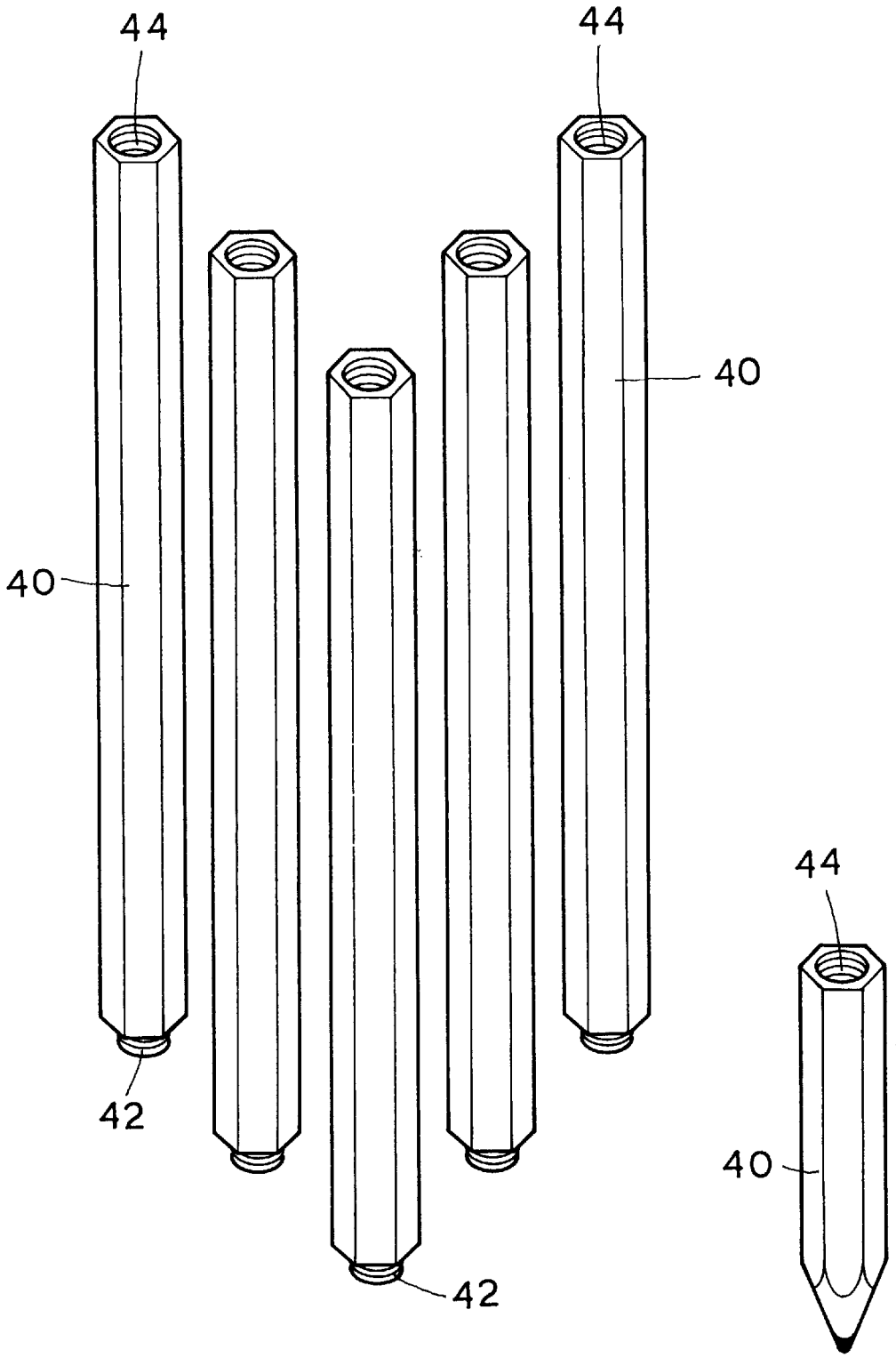
FIG. 8 shows a further embodiment of the present invention as compared with FIG. 6.

The pencil assemblies of the present invention as shown in FIG. 6 and 7 uses a plurality of main shanks 40 together with an auxiliary rod 60. The auxiliary rod 60 is made of plastic or wood and is provided thereon with a locking stub 61. When a main shank 40 is used to a degree which is inconvenient for holding, the locking stub 61 can be screw connected with a locking hole 43 provided on the main shank 40 to allow continuous use in writing. FIG. 8 shows that a plurality of main shanks 40 of the present invention can be provided directly on one end of each of them with a locking stub 42, while the other end thereof is provided directly with a locking hole 44, so that an almost used-up main shank 40 can be connected with another main shank 40 for use, thereby, the main shanks 40 can be continuously used. The pencil assembly of the present invention thereby is structurally simple and can make environmental protection be realized.

In conclusion, a main shank of the present invention can be provided with a locking stub, while a locking hole can be provided on a connecting shank; or the main shank can be provided with a locking hole, while the connecting shank can be provided with a locking stub. By mutual connecting of the locking stub and the locking hole, a pencil can be elongated in favor of holding, and the objects of saving resource and realizing environmental protection can be achieved. The aforesaid is only for illustrating a preferred embodiment of the present invention. It will be apparent to those skilled in this art that various modifications or changes can be made to the elements of the present invention without departing from the spirit, scope and characteristic of this invention. Accordingly, all such modifications and changes also fall within the scope of the appended claims and are intended to form part of this invention.

Having thus described the technical structure of my invention with novelty, industrial utility and improvement, therefore, what I claim as new and desire to be secured by letters patent of the united states are:

1. A pencil assembly comprising:

a main shank extending along a first longitudinal axis, the main shank comprising a separate single first writing shaft positioned within the main shank substantially along the entire length of the first longitudinal axis, and first and second ends, the single first writing shaft secured to inner wall surfaces of the main shank along the length of the first longitudinal axis;

a fixing annular member immovably secured to the second end of the main shank, the fixing annular member including a first locking stub extending outwardly along the first longitudinal axis away from the main shank along the first longitudinal axis, the locking stub comprising male threads;

a connecting shank extending along a second longitudinal axis, the connecting shank comprising a separate single second writing shaft positioned within the connecting shank substantially along the entire length of the longitudinal axis, and third and fourth ends between second longitudinal axis, the single second writing shaft secured to inner wall surfaces of the connecting shank along the length of the second longitudinal axis; and a fixing collar immovably secured to the third end of the connecting shank, the fixing collar including a locking hole at an open end thereof and positioned along the second longitudinal axis, the locking hole comprising female threads that are detachably secured on the male threads of the locking stub, such that the main shank and the connecting shank can be threadably attached to one another along the respective first and second axes.

2. The pencil assembly as claimed in claim 1, wherein, said locking stub is integrally formed as one with said main shank, and said fixing collar is integrally formed as one with said connecting shank.

3. The pencil assembly as claimed in claim 1 or 2, wherein, the first end of the main shank includes a second fixing collar.

* * * * *